United States Patent [19]

Benson

[11] Patent Number: 4,633,768

[45] Date of Patent: Jan. 6, 1987

[54] SUPPLEMENTAL VENTILATION APPARATUS FOR MANUFACTURED HOUSING

[75] Inventor: Robert J. Benson, DesPeres, Mo.

[73] Assignee: Intertherm Inc., St. Louis, Mo.

[21] Appl. No.: 718,844

[22] Filed: Apr. 1, 1985

[51] Int. Cl.[4] ..... F24D 5/00; F24F 7/00

[52] U.S. Cl. ..... 98/34.6; 98/35; 98/DIG. 7; 237/46

[58] Field of Search ..... 98/33.1, 34.6, 35, 48, 98/DIG. 6, DIG. 7; 165/16, 59; 237/46

[56] References Cited

U.S. PATENT DOCUMENTS

| | | | |
|---|---|---|---|
| 1,845,954 | 2/1932 | Bird | 98/35 X |
| 1,916,908 | 7/1933 | Stacey, Jr. et al. | 98/34.6 X |
| 2,032,103 | 2/1936 | Tise | 98/DIG. 7 X |
| 3,354,946 | 11/1967 | Dean, Jr. | 98/34.6 X |
| 4,062,400 | 12/1977 | Horowitz | 98/34.6 X |
| 4,201,121 | 5/1980 | Brandenburg, Jr. | 98/DIG. 6 X |
| 4,537,117 | 8/1985 | Cavestany et al. | 237/46 X |

*Primary Examiner*—Harold Joyce

*Attorney, Agent, or Firm*—Jerome A. Gross

[57] ABSTRACT

Supplemental ventilation apparatus is provided for manufactured housing whose window and door openings are tightly sealed when closed. Exterior air is drawn in by the furnace's room air circulating blower through a flexible duct flattened wideningly at its base to fit removably on the upstanding flange of a dampered inlet to the furnace's upper air inlet chamber, which is installed in the narrow top wall surface of the furnace forward of its accessory-mounting portion. When combined with an adequately powered attic exhaust system, negative pressure, which such exhaust system creates in the attic, acts through openings in the ceiling to draw off positive room air pressure. Thus stale room air is withdrawn and exhausted through the attic, without any increase in capacity of the room air circulating blower.

2 Claims, 4 Drawing Figures

FIG. 1
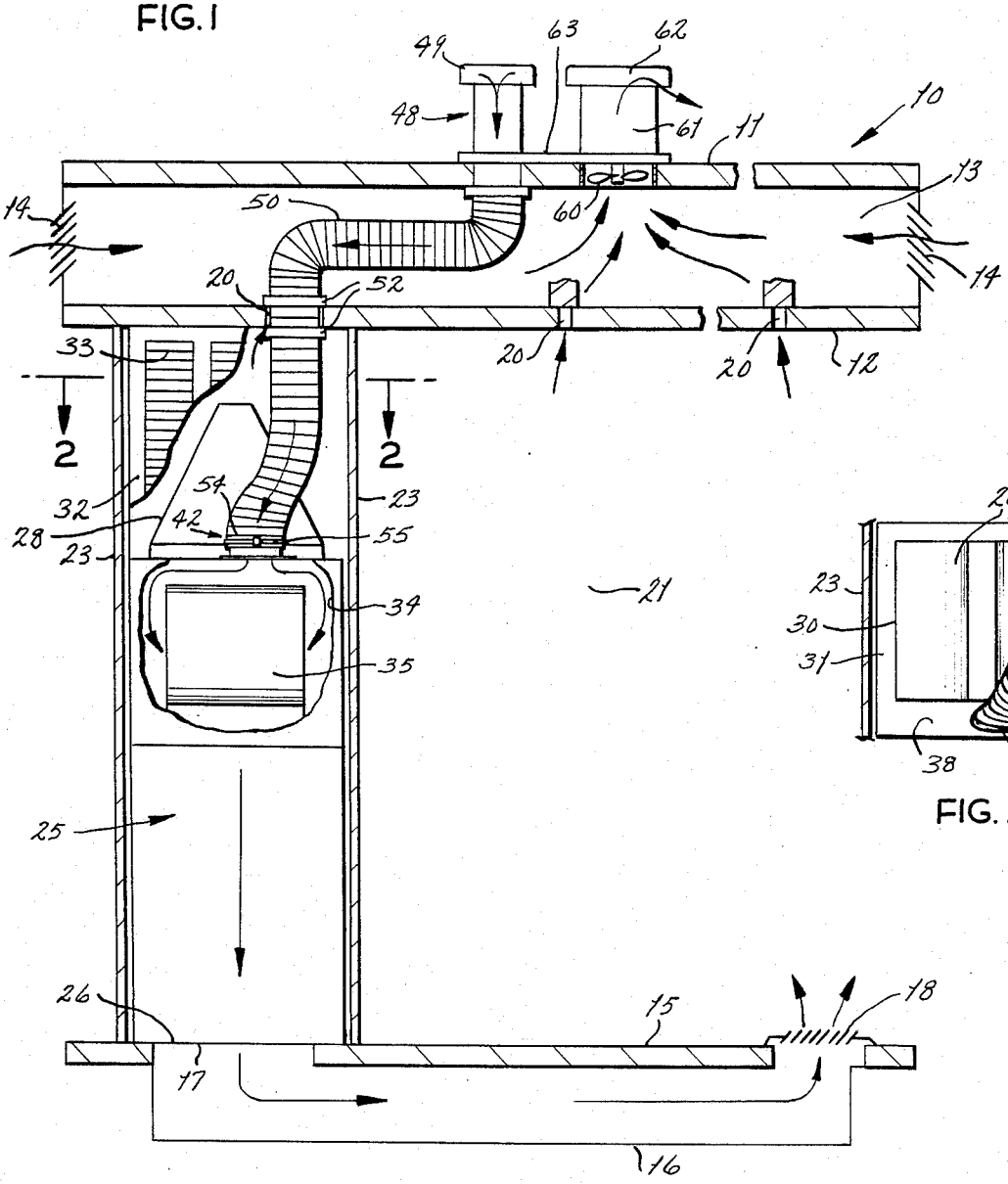
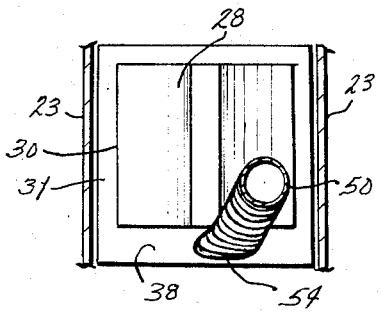
FIG. 2
FIG. 3
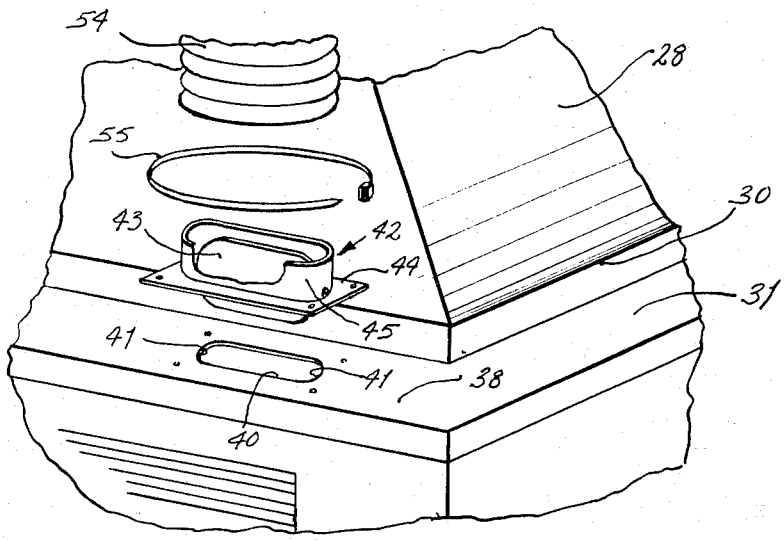

SUPPLEMENTAL VENTILATION APPARATUS FOR MANUFACTURED HOUSING

BACKGROUND OF THE INVENTION

Mobile homes and modular housing units are frequently referred to as "manufactured housing." Unlike conventional housing units built on site, manufactured housing units are relatively tightly sealed; their window and door openings are relatively windproof and their walls relatively free from cracks and discontinuities of insulation, etc. This has given rise to various difficulties; their insulating materials, for example, may give off noxious fumes. Accumulation of moisture, particularly in attic spaces, is also a problem.

Recently enacted regulations of the Housing & Urban Development Administration require manufacturers to make supplemental ventilation systems available, as purchaser options. One of several such regulatory options is: "A fresh-air inlet (not for combustion air) which draws its air from the exterior of the home (not the underside) . . . " which" . . . shall be continuously connected from a forced-air furnace to the exterior and be capable of providing at least 25 cubic feet per minute with the furnace fan in normal operation."

Since any of such supplemental ventilation provisions is a mere buyer's option, furnace manufacturers have sought ways to provide such option without making a fundamental increase in the capacity of their furnace blowers. At least one manufacturer has therefore turned to the use of a supplemental blower which will also ventilate the attic space. This type of apparatus includes a forced-air inlet fan installed in the attic space. This fan draws air from the exterior and divides it into two portions. The first portion puts the attic space under positive pressure (thereby driving out moist air through a remote attic outlet); the second portion is driven through a duct leading through the ceiling, to the furnace's room air circulating blower.

This solution has not been found applicable to those downflow furnaces, such as electric furnaces, which are designed for the installation of air conditioner coils on substantially the entire upper surface of the furnace cabinet. More fundamentally and less obviously, such an installation overlooks the basic problem how to rid the room space of foul air, because it puts the attic space as well as the room space under positive air pressure, and thus effectively eliminates the attic space as an outlet for air from the room space.

SUMMARY OF THE INVENTION

In the present invention, advantage is taken of the fact that while the external walls and window openings, etc. in manufactured housing are made very tight, the same is not true of the installation of the ceiling; numerous crevices or other unsealed openings are normally present between the ceiling and the attic space. Hence, in the prior art system above referred to, the attic space under a positive atmospheric pressure tends to increase the work load on the furnace blower, and if the forced air is not suitably divided between the attic space and the furnace blower, may drive attic fumes and moisture down into the room space.

The present invention goes contrary to this prior art system. In the present invention, an attic exhaust fan is used to draw air through the attic space from a remote inlet and thereby apply the negative attic air pressure through ceiling openings or crevices. This negative pressure, applied to the outlet side of the furnace blower, partly relieves its work load, making unnecessary any increase in its capacity. Further, for this eased airflow, a relatively small inlet into the blower cabinet will suffice.

To provide this small inlet, a width-wise elongated opening is accommodated in the narrow space in the furnace top wall forwardly of the space for mounting an air conditioner coil or other furnace accessory. The narrow space available would ordinarily be considered to be far too small to accommodate an air inlet opening. A correspondingly elongated damper is secured to this inlet opening; its upwardly-projecting flange receives the lower end of a conventional flexible duct, somewhat flattened and secured by a strap. For access for servicing the air conditioner coil, the strap is removed and the duct end pushed aside.

BRIEF DESCRIPTION OF THE DRAWINGS

FIG. 1 is an elevational view, partially broken away, showing an alcove-installed downflow electric furnace with a top mounted air conditioner, and having ventilating apparatus embodying the present invention.

FIG. 2 is a sectional view taken along line 2—2 of FIG. 1.

FIG. 3 is a fragmentary installation drawing showing the connection of a flexible duct of FIG. 1 to a narrow elongated opening in the top wall of the electric furnace thereshown.

DESCRIPTION OF THE PREFERRED EMBODIMENT

Figure 4:
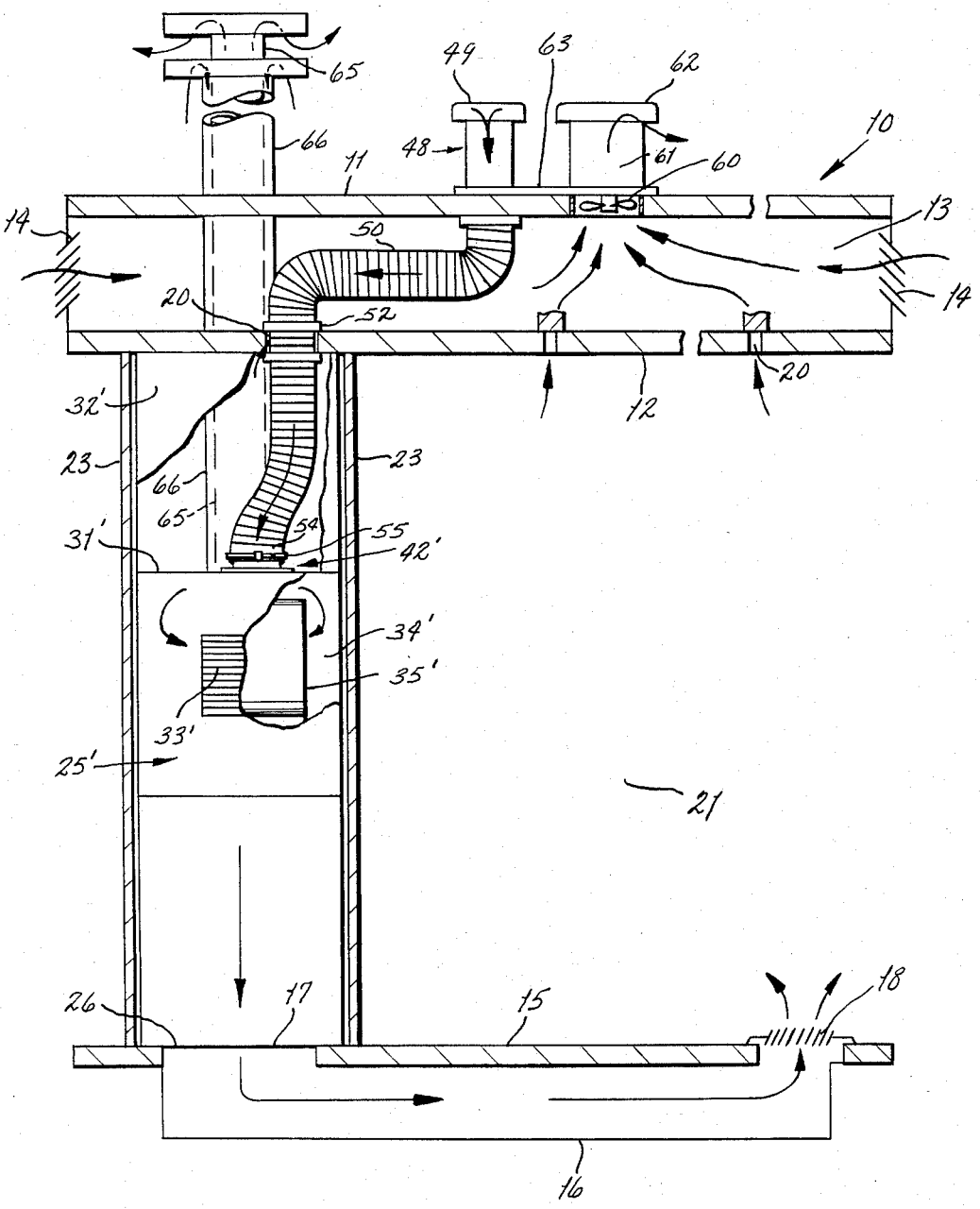
FIG. 4 is a view of the present invention as installed on a downflow furnace, such as a gas furnace, of the type having a top-mounted concentric flue.

FIG. 1 shows in somewhat schematic form the construction of a mobile home or other manufactured housing unit to which the present invention is applicable. The housing unit structure generally designated 10 includes a roof 11, a ceiling 12 installed spacedly therebeneath to provide an attic space 13, which has side ventilators 14. Side walls, windows, and outer doors, not shown, typical of modular housing construction, are tightly fitted when closed, to resist through flow of air.

The housing unit structure 10 shown also includes a floor 15 equipped with a subfloor heating duct 16 which receives hot air through a floor inlet 17 beneath the furnace to be described and discharges it through one or more outlet registers 18.

The floor 15 may have a subfloor not shown; in any event it and the roof 11 are tightly sealed to minimize loss of heat to the exterior. The ceiling 12 is installed without equivalent precautions for avoiding airflow between it and the attic space 13. Accordingly, there will be numerous openings 20, usually along joints, through which air may pass from the room space 21 to the attic space 13, especially when there are unequal pressures therein.

Installed against one of the outside walls of the housing unit 10, between alcove walls 23, is a downflow electric furnace generally designated 25, whose base outlet 26 discharges into the subfloor duct 16. The air so discharged is either heated in the furnace 25 or, in the summer season, cooled by flow through its A-type air conditioner evaporator coil 28, whose installation is a popular option. The evaporator coil 28, shown in phantom lines, when installed, covers the air inlet opening 30 of the furnace top wall 31, which serves as the furnace accessory mounting area.

In order to permit air flow to the evaporator coil 28 (or to the top air inlet opening 30 if no accessory is mounted on the furnace top wall 31), the installation includes an openable or removable panel 32 which has air-conducting louvers 33, above the level of the furnace top wall, through which room air is returned to the furnace 25 through its air inlet 30. The inlet 30 opens into an air inlet chamber 34 in the upper part of the furnace 25, from which the air is driven downward by a centrifugal blower 35 past electrical heating coils, not shown, to the furnace base outlet 26, and thence through the subfloor duct 16.

With existing furnaces of the type shown, a narrow area 38 on the furnace top wall 31 is left between the removable panel 32 and the furnace accessory mounting area 30. This area 38 is ordinarily much narrower than such accessory mounting area 30 itself.

In this conventional setting, ventilation problems may be present, as noted above under "Background of the Invention." It is to these problems that this invention is addressed.

The present ventilating apparatus is utilized as an optional installation for such standard furnace 25, by providing a widthwise elongated opening 40 through the narrower top wall area 38, as best seen in FIG. 3. The otherwise standard furnace shown is modified only by providing its sheet metal top wall 31 with a stamped knock-out, which on removal provides the opening 40. As seen, the elongated opening 40 has rounded ends 41. A similarly elongated presettable damper generally designated 42, equipped with a conventional tiltable control vane 43, is mounted, by screws through its horizontal mounting flange 44, onto the furnace top wall 31 in registration with the opening 40. The damper 42 has an upwardly extending bounding flange 45 in registration with and circumscribing the opening 40.

Mounted through the roof 11 of the housing unit 10 is an exterior air inlet generally designated 48, conventionally supplied with a rain cap 49. On its inward end is mounted the upper end of a flexible duct 50 of the conventional type whose perimeter is slightly greater than that of the bounding flange 45 of the damper 42, and whose shape is provided by a flexible helical wire. Its rounded exterior is indented by helical grooves between the wire turns. The duct 50 extends downward from the air inlet 48 (and to the extent necessary, laterally) through the attic space 13 and thence downward through the ceiling 12, to which it is mounted rather loosely by conventional annular mounting collars 52; the helical grooves in the duct surface provide one source of air openings 20 to the attic space 13.

The flexible duct 50 continues downward to a lower end portion 54, which as shown in FIGS. 1, 2 and 3, is elastically distorted by flattening to widthwise elongated shape. So distorted, it is brought forward and between the evaporator coil 28 and the removable panel 32 and secured onto the bounding flange 45 by an adjustable strap 55. Thus the diameter of the duct 50, which introduces outside air into the air inlet chamber 34, may substantially exceed the width of the narrow top wall 38.

So installed forwardly of the air conditioner coil 28 or other furnace accessory mounted on the top wall 31, the duct lower end 54 would interfere with their servicing, except for its easy removability when the strap 55 is released, access being had by removing the panel 32 above the furnace front, such access and strap removal also permits adjustment of the damper control vane 43, by which adjustment a desired balance is achieved between the re-circulation of room air and the inflow of exterior air.

By this installation, air is drawn through the exterior air inlet 48 by the room air circulating blower 35, to merge with the room air which the blower draws through the louvers 33 of the removable panel 32. This tends to raise the pressure of air in the room space 21 slightly above the exterior air pressure, when the window and door openings are tightly closed.

Preferably the present system also includes ventilation means which create a negative pressure in the attic space 13, to alleviate and draw off through openings 20, such positive pressure in the room space 21. For such attic ventilation, I provide an electric fan 60, powered by conventional wiring, not shown, and mounted at the interior side of an attic exhaust vent 61 which is equipped with a rain cap 62. Conveniently the attic exhaust vent 61 and the air inlet 48 are mounted on the same roof plate 63. Whenever the exhaust fan 60 is powered at the same time as the furnace blower 35, positive pressure is created by the blower 35 in the room space 21 while a relieving negative pressure is induced by the exhaust fan 60 in the attic space 13. In this way, the exhaust fan 60 augments the capacity of the furnace blower. The capacity of an exhaust fan 60, chosen for each installation, may be varied more readily than that of a furnace blower 35. It is therefore commercially advantageous to provide the optional increased ventilation of the room space by the capacity of the exhaust fan 60, without increase in capacity of the blower 35. Since the attic exhaust fan 60 is useful under conditions when the furnace blower 35 is not operating, it is preferably actuated by conventional attic ventilation controls, independently of the blower 35.

Referring now to FIG. 4, a gas burner furnace of the downflow type, generally designated 25'. Mounted on its top wall 31', as a conventional furnace accessory, is a conventional central flue 65 and surrounding concentric air inlet tube 66, the inlet air flowing to a conventional burner and heat exchanger, not shown, and thence upwardly and out through the flue 65. This combustion system is sealed from the room air circulation system, as is conventional.

Similar to the electric furnace 25 shown in the first described embodiment, the gas furnace 25' of FIG. 4 has an upper room air inlet chamber 34' containing a centrifugal room air blower 35'. In contrast to the electric furnace embodiment, the air inlet to the chamber 34' is through louvers 33' below its furnace top wall 31' in its forward wall. Hence a removable panel 32', installed above the furnace and normally aligned with the forward wall thereof, is imperforate; it is removable merely to provide access to such installations as are made on the furnace top wall 31'.

As in the embodiment of FIGS. 1–3, a damper 42' is installed on a widthwise elongated opening made in the furnace top wall 31' forwardly of the top mounted accessory (here the concentric air intake tube 66 and flue 65). The other elements shown in FIG. 4 correspond identically with those of FIG. 1, and are marked with the identical numerals. Since the description previously afforded to these numbered parts in FIG. 1 corresponds to their showing and functioning in FIG. 4, their description need not be repeated.

From this disclosure, variations will be apparent to those skilled in the art.

In the claims, the term "furnace accessory" is to be taken to mean any item or items used in connection with such furnaces, including but not limited to, air conditioning coils, combustion air inlet tubes and flues, and such controls as may be located on the furnace top wall.

I claim:

1. For use in a manufactured housing unit of the type having a roof and a ceiling spacedly therebeneath, whereby to provide room space below and attic space above such ceiling, there being an opening in such ceiling sufficient for passage of air therethrough, such housing unit having in such room space a downflow cabinet furnace of the type having in its upper portion a return air chamber, a return air inlet into such chamber, and an air circulating blower directing air from such chamber to a downflow outlet to such room space, the combination comprising A. exterior air intake apparatus including a supplemental, upward flanged opening into such return air inlet chamber extending through such furnace cabinet top wall, an adjustable damper in said supplemental opening, an outside air inlet through such roof, and a flexible duct leading downward from said outside air inlet and removably secured to said damper flange, whereby the room air circulating blower of such draws outside air through said damper to supplement the return air and thereby create a positive pressure in the room space, and whereby temporary removal of the flexible duct permits adjustment of the damper, and B. an outside attic air inlet and, spaced remotely therefrom, an attic exhaust vent having an exhaust fan, whereby operation of the attic exhaust fan creates a negative pressure in the attic space which, together with the positive pressure so created in the room space, withdraws air from the room space into the attic space for exhausting by the attic exhaust fan.

2. For use in a manufactured housing unit of the type having a roof and a ceiling spacedly therebeneath, there being an opening in such ceiling sufficient for passage of air therethrough, and having in such room space a downflow cabinet electric furnace of the type having a return air chamber and a return air inlet into the cabinet top wall leading into such chamber, such return air inlet being substantially rectangular and adapted to mount an air conditioning element, such furnace further having an air circulating blower directing air from such chamber to a downflow outlet, exterior air intake apparatus including a supplemental, upward flanged opening into such return air inlet chamber extending through such furnace cabinet top wall and positioned adjacent to such rectangular return air inlet, said upward-flanged opening being elongated and having rounded ends, an elongated adjustable damper in said supplemental opening, an outside air inlet through such roof, and a flexible duct leading downward from said outside air inlet and removably secured to said damper flange, in combination with an outside attic air inlet and, spaced remotely therefrom, an attic exhaust vent having an exhaust fan, whereby the room air circulating blower draws outside air through said damper to supplement the return air and thereby create a positive pressure in the room space, and whereby temporary removal of the flexible duct permits adjustment of the damper.

* * * * *